United States Patent [19]

Petrillo

[11] 4,333,604

[45] Jun. 8, 1982

[54] ECONOMIC ENERGY CONTROL

[76] Inventor: Gary M. Petrillo, 47 Corey Rd., North Haven, Conn. 06473

[21] Appl. No.: 253,692

[22] Filed: Apr. 13, 1981

[51] Int. Cl.[3] ..... E05B 65/00; H01H 27/06

[52] U.S. Cl. ..... 236/46 R; 70/57; 165/11 R; 200/61.67

[58] Field of Search ..... 70/57; 236/1 R, 46 R, 236/47; 200/61.64, 61.67, 61.68; 165/11

[56] References Cited

U.S. PATENT DOCUMENTS

| | | | |
|---|---|---|---|
| 4,091,866 | 5/1978 | Curatolo | 165/138 |
| 4,101,886 | 7/1978 | Grimes | 165/14 |
| 4,189,692 | 2/1980 | Bonnar | 200/61.67 X |

*Primary Examiner*—William E. Wayner
*Attorney, Agent, or Firm*—Walter Spruegel

[57] ABSTRACT

Controls for lights in a room with a swinging door for entry into and exit from the room, providing a main circuit for the lights, including a main switch normally closed to close the circuit, a time delay relay adapted, when energized, to hold the main switch in closed position for a preset time period and then shift the same to its open position, and a relay circuit, including a featured master switch of push button type having its push button in the form of a latch bolt, with this switch being mounted on the door so that the push button may serve as a latch bolt by being projectible into and retractible from an associated catch on the door jamb inside the room, with the master switch being closed to close the relay circuit when the latch bolt is retracted, and being open to open the relay circuit when the latch bolt is projected.

4 Claims, 3 Drawing Figures

ECONOMIC ENERGY CONTROL

BACKGROUND

This invention relates to economic energy control in general, and to economic control over the lights and other electric appliances in the separate room accommodations of multi-room establishments, such as hotels and motels in particular, and also office buildings, for example.

The usual electrical controls especially over the lights in the rooms of such establishments are particularly susceptible to wasting energy by the occupants. For example, what accounts for particularly wasteful use of these controls in hotels and motels in particular is the bad habit of all too many registered guests to leave the lights on while going out for dinner or even for the whole evening, or to leave them on when vacating the room even in broad daylight.

It is a primary object of the present invention to provide for the lights in each room unit of a hotel or motel, for example, a circuit control which by extremely simple manipulation by an occupant of a room makes for far greater economical use than hertofore of the lights by compelling the occupant to turn them off when leaving the room for any length of time or vacating the same.

It is another object of the present invention to provide for the lights in each room unit of a hotel or motel, for example, a circuit, and to arrange the aforementioned circuit control in the form of a main switch which is shiftable into a first position and spring-urged into a second position for opening and closing the circuit, respectively, a relay adapted, when energized, to shift the main switch into its first position, and a featured master switch of push button type of which the push button is formed as a latch bolt, and mounting the switch on the inside of the door of the room so that the button will serve as a latch bolt which by an occupant in the room is projectible into a catch on the adjacent door jamb to lock the door, and is retracible from the catch to unlock the door for opening, with the contacts of this master switch being by the latch bolt in its projected and retracted positions disengaged and engaged for deenergizing and energizing the relay, respectively. The featured master switch will thus indeed compel the occupant or occupants of the room to turn the lights off when leaving the room unoccupied for any length of time or when vacating the same, for the attending occupant will in either event have to retract the latch bolt with ensuing lights off to clear the door jamb and only then permit closure of the door. Conversely, the lights in the room will be on when the latch bolt is in its projected position. The latch bolt is intended to be thus projected by a guest after opening the door and coming within manipulative reach of the latch bolt for its projection preferably pursuant to instructions that may conveniently be posted on the outside of the door. Once inside the room, the occupant will close the door and also lock the same with the latch bolt, which is in general keeping with the custom of most travelers to lock themselves in their room during occupancy. Thus, insofar as the envisioned use of the latch bolt of the featured master switch by registered guests is concerned, the same is limited to turning the lights on when entering the room and usually locking the door from the inside, and turning the lights off when temporarily leaving the room or vacating the same, with the room being during temporary departure of the guest customarily locked by the latter from the outside with the conventional key which goes with the room. The featured master switch, while primarily intended for the aforementioned special use by privileged guests, also lends itself quite readily to different uses by personnel of the establishment and of outside services. Thus, the master switch lends itself to turning the lights on and off at the latch bolt while the door is open, which facilitates the work of chambermaids and repairmen, and also of emergency personnel when needed. The versatility in these respects of the master switch is, of course, highly desirable and quite advantageous and, moreover, is an attribute of the simple assembly of the circuit controls mostly from standard low-cost parts.

It is a further object of the present invention to provide the relay in the aforementioned light circuit control in the form of a time delay relay which on energization by the featured master switch for light turn-off delays the shift of the main switch from lights-on position to lights-off position for a preset time period measured in minutes. With this arrangement, such darkness as one may encounter in a room can be kept to very short periods. Thus, a guest entering a room need not be concerned with such darkness in the room as he or she may then encounter, for the guest will have no difficulty in reaching for the latch bolt and projecting it for immediate "on" response by the lights. Following turn-on of the lights in this fashion, the guest will in any event have light for such next activities as unpacking and putting the room in desired order, for if the latch bolt is left projected the lights will remain on, and they will also remain on, i.e., for the set time delay of the relay, if the latch bolt is retracted after the lights are on. The guest will thus have light for whatever immediate activity is planned until he or she comes to the accustomed locking of the door by the latch bolt. The delay in turning off the lights following retraction of the latch bolt may also come in handy when in vacating the room the latch bolt is retracted by the guest, but some, more or less, time may still elapse until the guest actually leaves the room while the lights are still on.

Also susceptible to waste of energy in each room unit of a hotel or motel, for example, are the customary heating and air-conditioning utility systems which during the applicable seasons are usually set at central master controls for average comfortable room conditions which in many cases may be further regulatable at room controls by the guests to satisfy their individual needs. The waste of energy here arises during the time or times when a room which is comfortably conditioned for occupancy is temporarily left empty by a registered guest or is vacated, in which case the energy involved in thus conditioning the empty room is wasted. It is, therefore, still another object of the present invention largely to eliminate such waste of energy by making provisions to run the seasonably responsive heating or air-conditioning system in each room at intervals which are so timed as to keep the room at preset minimum and maximum temperatures, respectively, when the room is empty.

The utility systems may be combined in a single unit which is connected in a main branch of a utility circuit which is closed by the aforementioned main switch in its second or lights-on position, meaning that whichever utility system is set for seasonal response will continuously be responsive to temperature controls when the lights are on. There is also provided a secondary utility circuit which includes, besides the main branch of the first mentioned utility circuit, a second lead with an interposed normally-open timer switch which, when closed, closes the secondary utility circuit. The timer switch is under the control of a timer in a circuit which is closed by the aforementioned main switch in its first or lights-off position. Thus, when the lights are off, the circuit of the timer is closed and the timer is then operated to close the associated switch at preset intervals for preset time periods, whereby the seasonally responsive utility system will then also respond to temperature controls at the same intervals for the same time periods.

Further objects and advantages will appear to those skilled in the art from the following, considered in conjunction with the accompanying drawings.

In the accompanying drawings, in which certain modes of carrying out the present invention are shown for illustrative purposes:

Figure 1:
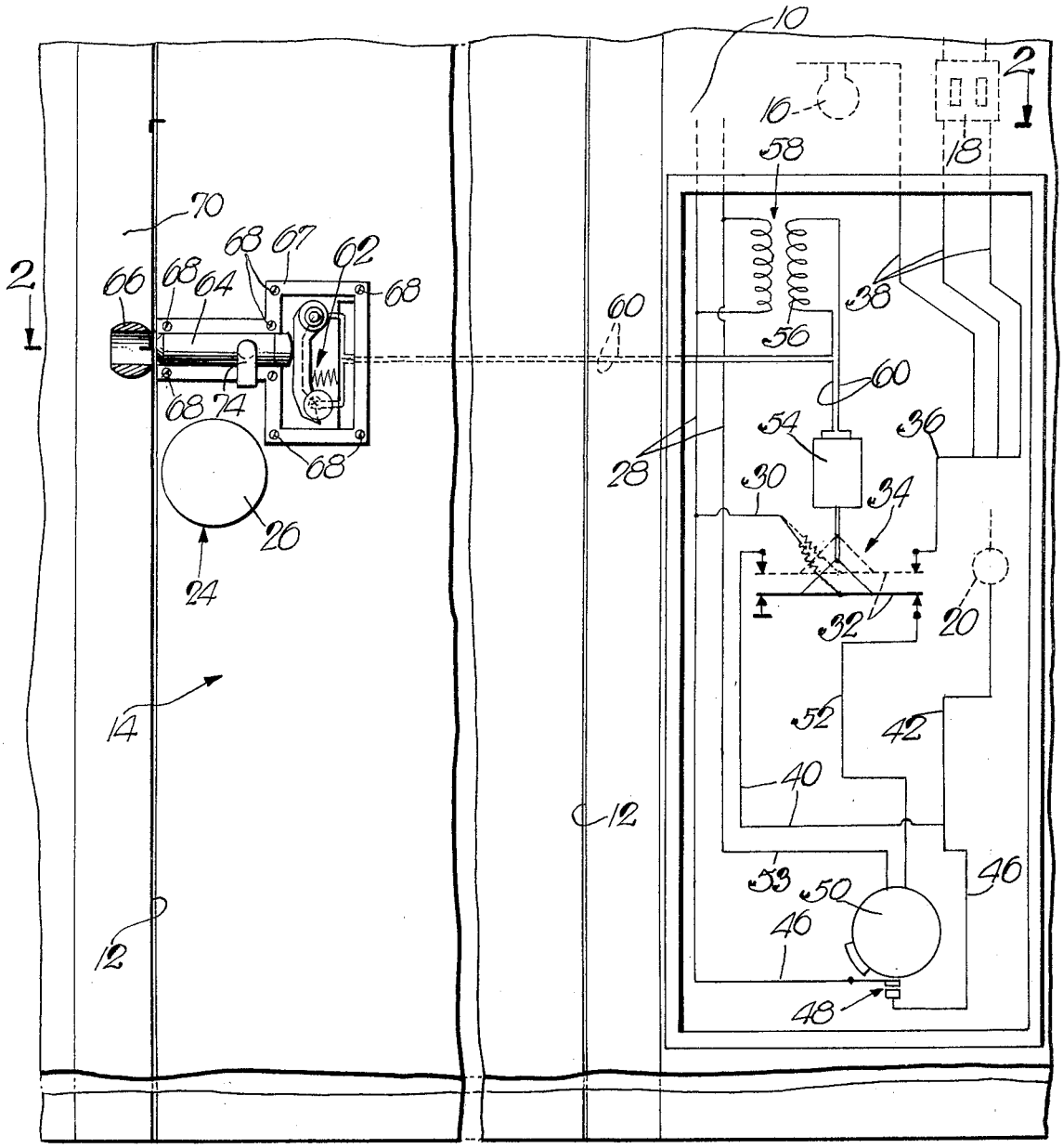
FIG. 1 is a fragmentary view of a room with electric light and utility installations and circuit controls therefor which embody the invention.

Referring to the drawings, and more particularly to FIG. 1 thereof, the reference numeral 10 designates the inside of a room, such as a motel room, for example, having an opening 12 and a hinged door 14 swingable into open and closed positions. The room is provided in this instance with a ceiling light 16 and a wall outlet 18 in which may be plugged another light and a television set, for example. The room is further provided with such utilities as a heater and an air-conditioner which may be combined into a heating and cooling unit 20, wherefore the term "air-conditioning" will be employed to cover the conditioning of air by heating or by cooling. This air-conditioning unit has suitable controls for switching from operation of either of its air-heating or air-cooling components to operation of the other component as the seasons change. The door is also provided with a lock 24 which is customarily secured by an outside key that goes with the room, with the lock being manipulatable by inner and outer knobs 26.

The energy source for the lights and air-conditioning unit is in this instance a 110 V power line 28. The lights, including the TV set, are connected in a main circuit which includes the power line 28, a lead 30, a conductive blade 32 of a main switch 34, and a lead 36 with parallel branches 38, with this circuit being closed to turn on the lights in the dotted-line position of the main switch 34 in which the blade 32 connects the leads 30 and 36.

The air-conditioning unit 20 is connected in a utility circuit which includes the power line 28, lead 30, main switch 34 and leads 40 and 42, with this unit 20 being interposed in the lead 42. This utility circuit is closed in the dotted-line position of the main switch 34 in which the blade 32 connects the leads 30 and 40. Thus, while the lights are "on" in the room, the air-conditioning unit is also "on" to put out sufficient heat or cool air, whichever applies, to keep the room at a normal, i.e., comfortable, temperature for occupancy.

Provisions are made to operate the air-conditioning unit 20 at recurring intervals for preset time periods when the lights in the room are "out", i.e., when the room is vacant or the occupant or occupants are asleep during the night. The air-conditioning unit 20 is then operative at such intervals for such time periods as to keep the room temperature at a "hold" temperature, i.e., a minimum temperature during the heating season and a maximum temperature during the cooling season, whichever applies for the present season, with the "hold" temperature being inadequate for comfortable occupancy of the room, but adequate for a truly worthwhile saving in energy and for rather quick return to normal temperature when the next occupancy of the room calls for comfortable room temperature. To thus operate the air-conditioning unit 20 at recurring intervals, there is provided a secondary circuit which includes, besides the power line 28 and lead 42, another lead 46 with an interposed normally-open switch 48, with this circuit being closed with each closure of the switch 48. Associated with the switch 48 is a timer 50 which, when operating, closes the switch 48 at preset intervals for preset time periods. The timer 50 is connected in a circuit which includes the power line 28, lead 30, the main switch 34 in its full-line position, and leads 52 and 53. The main switch 34 is normally spring-urged into the dotted-line position, and is shifted to its other, full-line position by a relay 54 in a circuit which includes the secondary or low-voltage winding 56 of a transformer 58, and a lead 60 with an interposed, normally-open master switch 62 which, when closed as shown, closes the circuit of the relay 54 to cause the latter to shift the main switch 34 to its full-line position and close the timer circuit for the explained operation of the timer 50.

Figure 2:
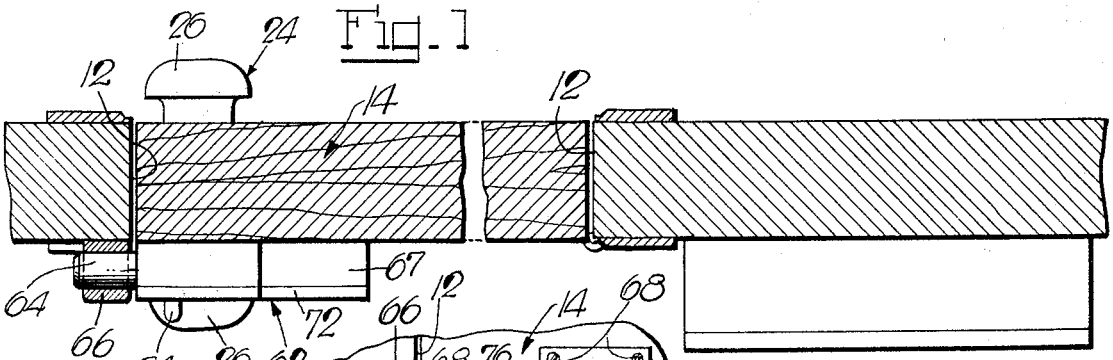
FIG. 2 is a fragmentary section through the room as taken on the line 2—2 of FIG. 1.
Figure 3:
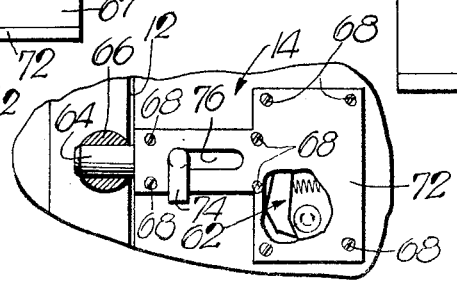
FIG. 3 is a fragmentary view of a prominent part of the featured circuit controls.

The master switch is of push button type having its push button formed in featured manner as a latch bolt 64 of a door latch which also provides a catch 66 in association with the latch bolt 64. In keeping with the latch bolt formation of the push button of the master switch 62, the latter is with its casing 67 mounted by screws 68 on the door 14 with its latch bolt 64 in association with the catch 66 which, in turn, is mounted on the adjacent door jamb 70 on the inside of the room, with the latch bolt 64 being projectible into and retractible from locking register with the catch 66. The casing 67 of the master switch 62 is closed by a cover plate 72, and the latch bolt 64 is manipulatable at a handle 74 which extends through a clearance slot 76 in the cover plate 72. Thus, the circuit of the relay 54 will be closed by the latch bolt 64 on retracting the same to its release position (FIG. 1) in which the door 14 is unlocked from the inside of the room, and this same circuit will be opened when on projection of the latch bolt 64 into the catch 66 (FIGS. 2 and 3) the master switch 62 is spring-returned to its normally-open position. For a reason explained hereinafter, the relay 34 is a time delay relay manufactured by Syracuse Electronics Company, with this relay, when energized, holding the main switch 34 in its dotted-line or "lights-on" position for a preset time period before shifting this switch to its other or "lights-off" position.

In operation, a guest may take over occupancy of the room by unlocking the door 14 with the key from the outside and then open the door and enter the room and as soon as possible project the latch bolt 64 to turn on the lights and also the air-conditioning unit 20. The guest may next close the door and unpack and get the room in desired condition. To thus close the door, the guest must first retract the latch bolt 64 to clear the catch 66 and in so doing will close the master switch 62 and, hence, also the circuit of the relay 54 which will then start its time delay action. If on such retraction of the latch bolt the guest immediately reverses and again projects the same, the started time delay cycle of the relay 54 is interrupted and the main switch will remain in its dotted-line position, with the result that the lights and air-conditioning unit will not go "off" at all but remain "on". However, if on such retraction of the latch bolt 64 the same should perchance be left in its retracted position while the door is still open, the started time delay cycle of the relay 54 will endure to its natural end and the main switch 34 will then be shifted to its full-line or "lights-off" position with ensuing turn-off of the lights and air-conditioning unit, so that the guest will then be compelled to again project the latch bolt in order to turn on the lights and air-conditioning unit again. For finally closing the door, the guest will first have to retact the latch bolt 64 in order to clear the catch 66 which will start the relay 54 on its time delay cycle, but since the average guest will, on such retraction of the latch bolt and closure of the door, immediately project the latch bolt again into locking register with the catch 66, the started time delay cycle of the relay 54 will be interrupted and the main switch 34 will remain in its dotted-line "lights-on" position and leave the lights "on". Thus, while the guest then remains in the room, the lights are "on" and the air-conditioning unit will quickly bring the room to the preset comfortable temperature for occupancy.

If the guest should leave the room temporarily, as for going out for business or dinner or for pleasure the whole evening, for example, the guest will unlock the door at the latch bolt 64 and open the door for exit, and he or she will on leaving customarily close the door and lock the same from the outside with the key. Unlocking of the door at the latch bolt in this fashion causes energization of the relay 54 which will then pass through its time delay cycle before shifting the main switch 34 to its full-line or "lights-out" position, but the door will thus be closed most likely before the end of the time delay cycle of the relay so that the lights are still "on" when the guest leaves the room and go out only after the door is closed. With the guest thus temporarily departed from the room, the lights are "off" and the air-conditioning unit is operating only intermittently, with ensuing considerable saving in energy.

When a guest finally vacates the room, he or she unlocks the door at the latch bolt 64 and opens the door to leave the room for the last time. Here again, unlocking of the door in this fashion brings about energization of the relay 54 and, hence, start of its time delay action which may last until the guest has left the room, in which case the lights stay "on" until the guest has left. However, if the time delay action of the relay should reach its natural end and the lights go out in consequence while the guest is still in the process of leaving, this may not interfere with the guest's departure, but if it should interfere, the guest may help himself or herself to additional light of adequate duration by operation of the latch bolt, as will be readily understood. Further, many guests are accustomed to closing the door on vacating a hotel or motel room, but as many other guests are accustomed to leave the door open when vacating the room. However, the lights will in any event go "off" and stay "off" for as long as the room remains vacant and regardless of whether the last occupant closed the door or left it open. Thus, with the lights in a room being "off" and the air-conditioning unit therein running only intermittently during temporary absence of a guest and during each vacancy of the room, the saving in energy assumes quite significant values.

What is claimed is:

1. A system for controlling the energy consumption of an energy-operated device in a room having a door movable into open and closed positions and a source of electrical energy, comprising a circuit for said device including said energy source, for rendering said device operative and inoperative on closing and opening said circuit, respectively a first switch in said circuit spring-urged into closed position and shiftable into open position to close and open said circuit respectively, a time delay relay adapted when energized, to hold said switch in said closed position for a preset delay period and then shift it into said open position, a circuit for said relay including a master switch of push button type mounted on said door and having its push button formed as a latch bolt manipulatable on the inside of said door, a catch in the room into and from which said latch bolt is projectible and retractible to lock and unlock said door, respectively, from the inside of the room, with said master switch being opened and closed to open and close said relay circuit on projection and retraction, respectively, of said latch bolt.

2. A control system as in claim 1, in which said device is a lighting device.

3. A control system as in claim 1, in which said device is an air-conditioning device.

4. A system for controlling the energy consumption of lighting and air-conditioning devices in a room having a door movable into open and closed positions, and a source of electrical energy, comprising a main circuit including said energy source and having a first lead and first and second parallel branches in which said lighting and air-conditioning devices are interposed, a secondary circuit including said energy source and said second branch and having a second lead with an interposed normally-open timer switch adapted, when closed, to close said secondary circuit for operation of said air-conditioning device, a timer, a timer circuit including said energy source and first lead and having a third lead, a main switch normally urged into a first position in which to connect said first lead with said circuit branches and thereby close said main circuit via said branches to operate said heating and air-conditioning devices, and shiftable into a second position to connect said first lead with said third lead to close said timer circuit and operate said timer switch at preset intervals for preset time periods, a time delay relay adapted, when energized, to hold said main switch in said first position for a preset delay period and then shift it into said second position, a relay circuit adapted, when closed, to energize said relay, with said relay circuit including a master switch of push button type mounted on said door and having its push button formed as a latch bolt manipulatable on the inside of said door, a catch in the room into and from which said latch bolt is projectible and retactible to lock and unlock said door, respectively, from the inside of the room, with said master switch being opened and closed to open and close said relay circuit on projection and retraction of said latch bolt, respectively.

* * * * *